US012297658B2

(12) United States Patent
Iwata

(10) Patent No.: US 12,297,658 B2
(45) Date of Patent: May 13, 2025

(54) METHOD OF MANUFACTURING BUCKLING-RESTRAINED BUILDING MATERIAL

(71) Applicants: Kawakin Core-Tech Co., Ltd., Saitama (JP); Daiwa House Industry CO., LTD., Osaka (JP)

(72) Inventor: Mamoru Iwata, Kanagawa (JP)

(73) Assignees: KAWAKIN CORE-TECH CO., LTD., Saitama (JP); DAIWA HOUSE INDUSTRY CO., LTD., Osaka (JP)

( * ) Notice: Subject to any disclaimer, the term of this patent is extended or adjusted under 35 U.S.C. 154(b) by 335 days.

(21) Appl. No.: 18/003,653

(22) PCT Filed: Feb. 15, 2021

(86) PCT No.: PCT/JP2021/005542
§ 371 (c)(1),
(2) Date: Dec. 28, 2022

(87) PCT Pub. No.: WO2022/034701
PCT Pub. Date: Feb. 17, 2022

(65) Prior Publication Data

US 2023/0243174 A1 Aug. 3, 2023

(30) Foreign Application Priority Data

Aug. 11, 2020 (JP) ..... 2020-135580

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04H 9/0237
See application file for complete search history.

(56) References Cited

U.S. PATENT DOCUMENTS

2023/0055344 A1* 2/2023 Cheng ..... E04H 9/0215
2023/0243174 A1* 8/2023 Iwata ..... E04H 9/0237 52/745.19

FOREIGN PATENT DOCUMENTS

JP 4665232 B2 4/2011
JP 2014-043723 A 3/2014
(Continued)

OTHER PUBLICATIONS

WIPO, International Search Report for International Application No. PCT/JP2021/005542, Mar. 9, 2021.
(Continued)

*Primary Examiner* — Joshua K Ihezie

(57) ABSTRACT

A predetermined amount of clearance is secured with high accuracy between a core material and core-material-facing surfaces of two buckling-restrained members.

In a method of manufacturing a buckling-restrained building material, clearance-maintaining members 18 for securing a predetermined amount of clearance Δt between a core material 2 and core-material-facing surfaces 3*d*, 3*d* of two buckling-restrained members 1, 1 sandwiching the core material are disposed between the core-material-facing surfaces. The method comprises a clearance adjustment step for applying a surface treatment for adjusting an amount of the clearance on clearance reference surface portions 3*e* which are parts of the core-material-facing surface and are in contact with the clearance-maintaining members, and a smoothing step for performing a smoothing process of the core-material-facing surface before the clearance adjustment step. In the clearance adjustment step, the surface treatment is not applied to a surface portion other than the clearance reference surface portions on the core-material-facing surface.

5 Claims, 13 Drawing Sheets

(56) References Cited

FOREIGN PATENT DOCUMENTS

| | | |
|---|---|---|
| JP | 6644370 B1 | 2/2020 |
| JP | 6709452 B1 | 6/2020 |

OTHER PUBLICATIONS

WIPO, International Preliminary Report on Patentability including Written Opinion for International Application No. PCT/JP2021/005542, Mar. 9, 2021.
Japan Patent Office, Office Action for Japanese Patent Application No. 2020-135580, Aug. 11, 202.

* cited by examiner

METHOD OF MANUFACTURING BUCKLING-RESTRAINED BUILDING MATERIAL

TECHNICAL FIELD

The present invention relates to a method of manufacturing buckling-restrained building materials, such as buckling-restrained braces, which are incorporated between stories of a main framework of a structure and reduce damage of the structure by absorbing energy by plastic deformation when inter-story deformation occurs.

BACKGROUND ART

As this type of the buckling-restrained building material, a buckling-restrained brace composed of a core material sandwiched between two buckling-restrained members is conventionally known. For example, Patent Literature 1 and 2 discloses a buckling-restrained brace which is manufactured such that a core material made of steel is sandwiched between two buckling-restrained members, each of which has a frame plate made of steel plate filled with concrete or mortar (curable material), and the frame plates of the two buckling-restrained members are welded together. In this buckling-restrained brace, clearance-maintaining members are disposed between the core material and the core-material-facing surfaces of the two buckling-restrained members to secure a predetermined amount of clearance between the core material and the core-material-facing surfaces of the two buckling-restrained members.

CITATION LIST

Patent Literature

Patent Literature 1: Japanese Patent No. 6644370.
Patent Literature 2: Japanese Patent No. 6709452.

SUMMARY OF INVENTION

Technical Problem

In the buckling-restrained building material such as the buckling-restrained brace, a load that compresses the core material in the longitudinal direction may be applied. If the core material does not buckle and exhibits appropriate restoring force under such a load, the buckling-restrained building material can also function as an earthquake-resistant member/seismic-response member. For the buckling-restraining building material to function as the earthquake-resistant member/seismic-response member in this way, it is important to maintain a predetermined amount of clearance between the core material and the core-material-facing surfaces of the two buckling-restrained members with high accuracy. More specifically, if the clearance is too wide, the core material is plastically deformed locally in a direction in which the two buckling-restrained members face each other (the direction perpendicular to the longitudinal direction of the core material and the direction in which the two buckling-restrained members face each other) during an axial compressive loading of the core material. Conversely, if the clearance is too narrow, the core material is restricted by the two buckling-restrained members and cannot deform sufficiently in the direction in which the two buckling-restrained members face each other during the axial compressive loading of the core material. In this case, the compressive axial force of the core material flows to the buckling-restrained members.

However, in the conventional method of maintaining the clearance, it was difficult to maintain the predetermined amount of the clearance with high accuracy.

Solution to Problem

An aspect of the present invention is a method of manufacturing a buckling-restrained building material in which clearance-maintaining members for securing a predetermined amount of clearance between a core material and core-material-facing surfaces of two buckling-restrained members sandwiching the core material are disposed between the core-material-facing surfaces of the two buckling-restrained members, and the method comprises a clearance adjustment step for applying a surface treatment for adjusting an amount of the clearance on clearance reference surface portions which are parts of the core-material-facing surface and are in contact with the clearance-maintaining members, and a smoothing step for performing a smoothing process of the core-material-facing surface before the clearance adjustment step, and in the clearance adjustment step, the surface treatment is not applied to a surface portion other than the clearance reference surface portions on the core-material-facing surface.

In the present aspect, the surface treatment for adjusting an amount of the clearance is applied to the clearance reference surface portions on the core-material-facing surface of the buckling-restrained member with which the clearance-maintaining members contact. For example, the surface treatment such as shaving the clearance reference surface portions on the core-material-facing surface, attaching a sheet or applying a coating material to the clearance reference surface portions on the core-material-facing surface is applied, thereby a level adjustment of the clearance reference surface portions is performed and an amount of the clearance is adjusted.

In the present aspect, since such a surface treatment is applied to portions of the core-material-facing surface (portions of the surface including the clearance reference surface portions), an area to be applied by the surface treatment is smaller than when the surface treatment is applied to the entire core-material-facing surface. The smaller the area to be applied by the surface treatment, the easier it is to achieve an accuracy of the level adjustment of the clearance reference surface portions by the surface treatment. Therefore, according to the present aspect, it is easier to perform highly accurate level adjustment of the clearance reference surface portions than in the case where the surface treatment for adjusting an amount of the clearance is applied to the entire core-material-facing surface.

If the level of the clearance reference surface portions can be adjusted with high accuracy, it is possible to sandwich the clearance-maintaining members between the core-material-facing surfaces of the two buckling-restrained members without a gap and with appropriate sandwiching force. As a result, an amount of the clearance between the core material and the core-material-facing surfaces of the two buckling-restrained members appropriately corresponds to a size accuracy of the clearance-maintaining members, thereby securing a predetermined amount of the clearance with high accuracy.

Also, in the present aspect, before the clearance adjustment step, a previously process for the smoothing process of the core-material-facing surface is performed, so that a work of the surface treatment for adjusting an amount of the clearance in the clearance adjustment step (the surface treatment for the level adjustment of the clearance reference surface portions) becomes easy, and an amount of the clearance can be adjusted with higher accuracy.

In addition, the above-mentioned Patent Literature 1 and Patent Literature 2 disclose a technique of applying a smoothing process only to the clearance reference surface portions, which is a portion of the core-material-facing surface that the clearance-maintaining members contacts. However, this smoothing process is a process to even out and smooth so-called unevenness, and is not a surface treatment for adjusting an amount of the clearance (a surface treatment for the level adjustment of the clearance reference surface portions). In the techniques disclosed in Patent Literature 1 and Patent Literature 2, the level adjustment of the clearance reference surface portions is separately performed by a level adjustment process for the entire core-material-facing surface (a level adjustment process performed separately from the smoothing process). That is, after adjusting a level of the clearance reference surface portions by the level adjustment process for the entire core-material-facing surface, only the clearance reference surface portions are applied to the smoothing process to even out the unevenness, so it is understood that a technical idea of the techniques is different from the present invention.

Also, in the method of manufacturing the buckling-restrained building material, the clearance-maintaining members may be lower rigidity or strength than the core material and may be sandwiched between the core-material-facing surface of at least one of the two buckling-restrained members and the core material.

The clearance-maintaining members are known to be arranged on the side of the core material in the longitudinal direction, as described in the above-mentioned Patent Literature 1 and Patent Literature 2. Since this clearance-maintaining members are sandwiched between the core-material-facing surfaces of the two buckling-restrained members on the side of the core material in the longitudinal direction, the thickness of the clearance-maintaining members must include the thickness of the core material plus the amount of clearance. As a result, the clearance-maintaining members become large and heavy, and a work load in handling the clearance-maintaining members increases.

On the other hand, the clearance-maintaining members of the present aspect are sandwiched between the core material and the core-material-facing surface of at least one of the two buckling-restrained members. Therefore, since the thickness of the clearance-maintaining members may be only the amount of the clearance, the clearance-maintaining members can be small and light, and the work load in handling the clearance-maintaining members can be reduced.

Moreover, the clearance-maintaining members of the present aspect are members with lower rigidity or strength than the core material. Therefore, when the buckling-restrained building material is used, the clearance-maintaining members interposed between the core material and the core-material-facing surfaces of the two buckling-restrained members can exhibit characteristics that do not prevent deformation of the core material during an axial compressive loading of the core material.

Also, the method of manufacturing the buckling-restrained building material may include a pressurization step of disposing the core material and the clearance-maintaining members between the core-material-facing surfaces of the two buckling-restrained members and pressurizing the two buckling-restrained members in a direction closer to each other.

Even when the level adjustment of the clearance reference surface portions is performed with high accuracy, when the core material and the clearance-maintaining members are arranged between the core-material-facing surfaces of the two buckling-restrained members and the two buckling-restrained members are merged, various manufacturing errors accumulate, and there is a possibility that a gap is created between the clearance-maintaining members and the core-material-facing surface of the buckling-restrained member or between the clearance-maintaining members and the core material. When such a gap is created, an amount of the clearance between the core material and the core-material-facing surfaces of the two buckling-restrained members is increased by the amount of the gap rather than the thickness of the clearance-maintaining members, and there is a possibility that a predetermined amount of clearance cannot be secured with high accuracy.

According to the present aspect, when the two buckling-restrained members are merged in this manner, the pressurization step in which the two buckling-restrained members are pressurized in a direction for closing each other is performed, thereby the two buckling-restrained members can be displaced to eliminate the gap. Therefore, it is possible to sandwich the clearance-maintaining members between the core-material-facing surfaces of the two buckling-restrained members without the gap, and a predetermined amount of clearance is secured with high accuracy.

Here, in order to reliably eliminate the gap, it is necessary to perform the pressurization step so as to displace the buckling-restrained member until the maximum possible gap is eliminated. Therefore, if the range of possible gap amounts is large, the clearance-maintaining members are greatly crushed in the pressurization step when an actual amount of the gap is minimum, and an amount of the clearance between the core material and the core-material-facing surfaces of the two buckling-restrained members does not appropriately correspond to the size accuracy of the clearance-maintaining members, and there is a possibility that a predetermined amount of the clearance cannot be secured with high accuracy.

However, according to the present aspect, as described above, the clearance reference surface portions with which the clearance-maintaining members contact is level-adjusted with high accuracy by the clearance adjustment step, so that the range of the possible gap amount is smaller than the conventional art. Therefore, when the pressurization step is performed to displace the buckling-restrained member until the maximum possible gap is eliminated, the clearance-maintaining members are not greatly crushed even if the actual amount of the gap is minimum. Therefore, since the clearance-maintaining members can be sandwiched between the core-material-facing surfaces of the two buckling-restrained members without the gap and with appropriate sandwiching force, the amount of the clearance can be appropriately corresponded to the size accuracy of the clearance-maintaining members, and a predetermined amount of the clearance is secured with high accuracy.

Also, in the method of manufacturing the buckling-restrained building material, a measurement step of performing a measurement for grasping an amount of the clearance may be included, and the clearance adjustment step may be repeated until a measurement result of the measurement step falls within a target accuracy range of the predetermined amount.

In the present aspect, the clearance adjustment step is repeated until the amount of the clearance grasped by the measurement result of the measurement step is within the target accuracy range of the predetermined amount, so that the amount of the clearance can be adjusted with high accuracy within the target accuracy range (allowable error range) of the predetermined amount.

In addition, a measurement method for grasping the amount of the clearance is not particularly limited, but if it is difficult to directly measure the amount of the clearance, for example, an indirect measurement method, such as estimating the amount of the clearance from the result of measuring a distance between outer walls of the two buckling-restrained members in the state where the core material and the clearance adjustment member are sandwiched, is acceptable.

Also, in the method of manufacturing the buckling-restrained building material, the clearance reference surface portions may be provided at a plurality of locations separated from each other on the core-material-facing surface.

In the present aspect, since the clearance reference surface portions are provided at a plurality of locations separated from each other on the core-material-facing surface, the clearance-maintaining members are dispersedly arranged. As a result, the amount of the clearance between the core material and the core-material-facing surface of the buckling-restrained member can be made a predetermined amount over the entire surface, while a ratio of an area occupied by the clearance reference surface portions with which the clearance-maintaining members contact is kept small in the core-material-facing surface of the buckling-restrained member. If the ratio of the area occupied by the clearance reference surface portions in the core-material-facing surface of the buckling-restrained member is small, an area of the clearance reference surface portions where the surface treatment is applied can be reduced, and highly accurate level adjustment of the clearance reference surface portions becomes easier, it becomes easier to secure a predetermined amount of the clearance with high accuracy.

Another aspect of the present invention is a method for manufacturing a buckling-restrained building material in which a core material is sandwiched between two buckling-restrained members filled with a curable material in a frame plate, and the method comprises a step in which clearance-maintaining members for securing a predetermined amount of a clearance between the core material and the core-material-facing surfaces of the two buckling-restrained members is placed on the pre-cured curable material which forms the core-material-facing surface of at least one of the two buckling-restrained members, and the clearance-maintaining members are pushed into the pre-cured curable material to a position where the amount of the clearance becomes the predetermined amount.

In the present aspect, when the clearance-maintaining members are placed on the core-material-facing surface of at least one of the buckling-restrained members, the core-material-facing surface is in a state before curing of the curable material (concrete, mortar, etc.), thereby the clearance-maintaining members can be pushed into the pre-cured curable material. Therefore, in the present aspect, by pushing the clearance-maintaining members into the pre-cured curable material, the clearance-maintaining members are positioned at a position where the amount of the clearance becomes a predetermined amount (a position in the direction in which the two buckling-restrained members face each other). This makes it possible to adjust the amount of the clearance without performing a surface treatment for adjusting the amount of the clearance on the core-material-facing surface of the buckling-restrained member (the curable material after curing). Therefore, it is possible to easily secure a predetermined amount of clearance with high accuracy.

Still another aspect of the present invention is a method for manufacturing a buckling-restrained building material in which a core material is sandwiched between two buckling-restrained members filled with a curable material in a frame plate, and the method comprises a step in which, for at least one of the two buckling-restrained members, clearance-maintaining members for securing a predetermined amount of a clearance between the core material and the core-material-facing surfaces of the two buckling-restrained members is placed on a surface within the frame plate that faces the core material through the curable material before or after filling a pre-cured curable material in the frame plate, and a step in which the core material is arranged in contact with the clearance-maintaining members and the two buckling-restrained members are merged.

In the present aspect, before filling the pre-cured curable material into the frame plate, the clearance-maintaining members are placed on a surface within the frame plate, and then the pre-cured curable material is filled in the frame plate. Alternatively, after filling the pre-cured curable material in the frame plate, the clearance-maintaining members are inserted in the pre-cured curable material, and the clearance-maintaining members are placed on a surface within the frame plate. According to this, by controlling the height of the clearance-maintaining members from the surface within the frame plate with high accuracy, it is possible that the core material is positioned such that a clearance between the core-material-facing surface formed by the curable material filled in the frame plate and the core material arranged so as to contact with the clearance-maintaining members placed on the surface within the frame plate is a predetermined amount. Since the clearance-maintaining members in the present aspect are not placed on the core-material-facing surface formed by the curable material, the amount of the clearance can be adjusted without applying a surface treatment for adjusting the amount of the clearance to the core-material-facing surface (curable material after curing). Therefore, it is possible to easily secure a predetermined amount of the clearance with high accuracy.

Advantageous Effects of Invention

According to the present invention, it becomes easy to secure a predetermined amount of the clearance between the core material and the core-material-facing surfaces of the two buckling-restrained members with high accuracy.

DESCRIPTION OF EMBODIMENTS

Embodiment 1

Hereinafter, an embodiment (hereinafter, this embodiment will be referred to as "embodiment 1") in which the present invention is applied to a method of manufacturing a buckling-restrained brace as a buckling-restrained building material will be described.

Note that the buckling-restrained building material manufactured by the manufacturing method according to the present invention is not limited to use as a brace (diagonal beam), but can also be utilized to use such as beams, columns, foundations, etc., for example, and the buckling-restrained brace of the embodiment 1 described below can be used for beams, columns, foundations, and the like.

Figure 1:
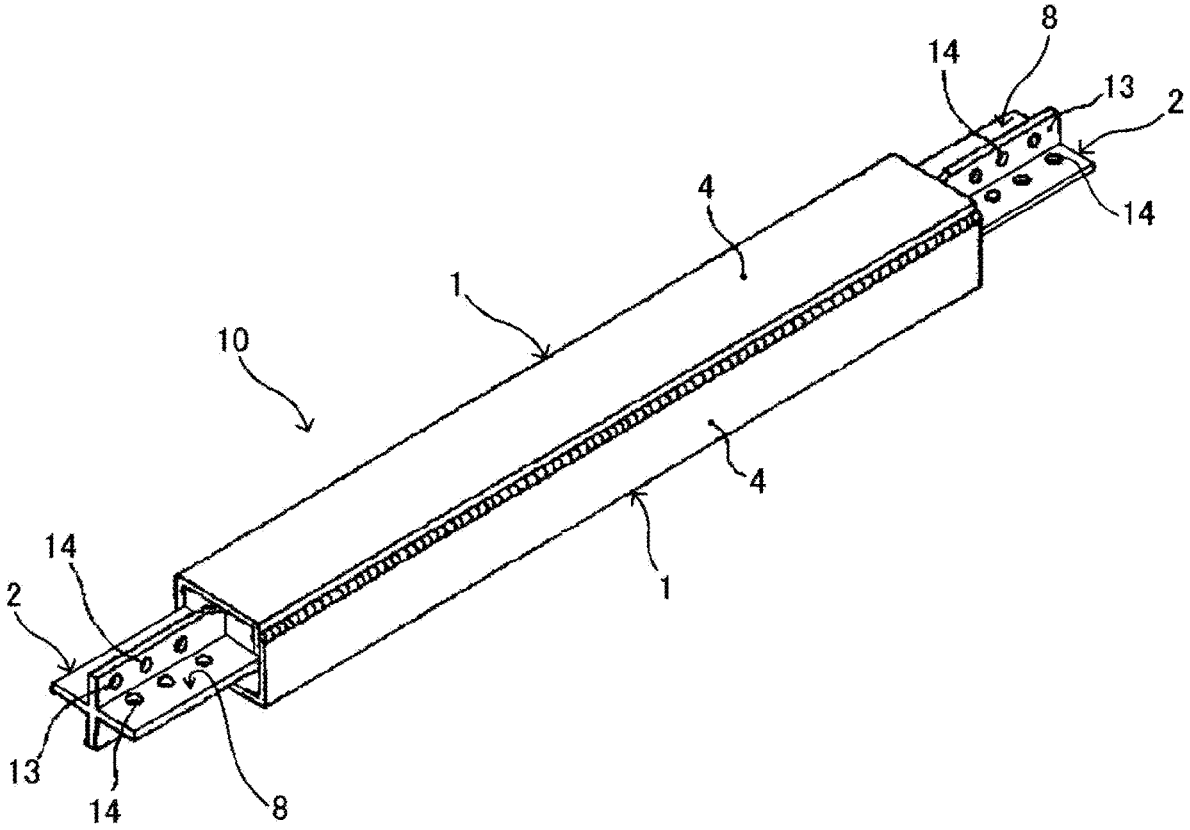
FIG. 1 is a perspective view of a buckling-restrained brace according to an embodiment 1.

FIG. 1 is a perspective view of the buckling-restrained brace according to the embodiment 1.

Figure 2:
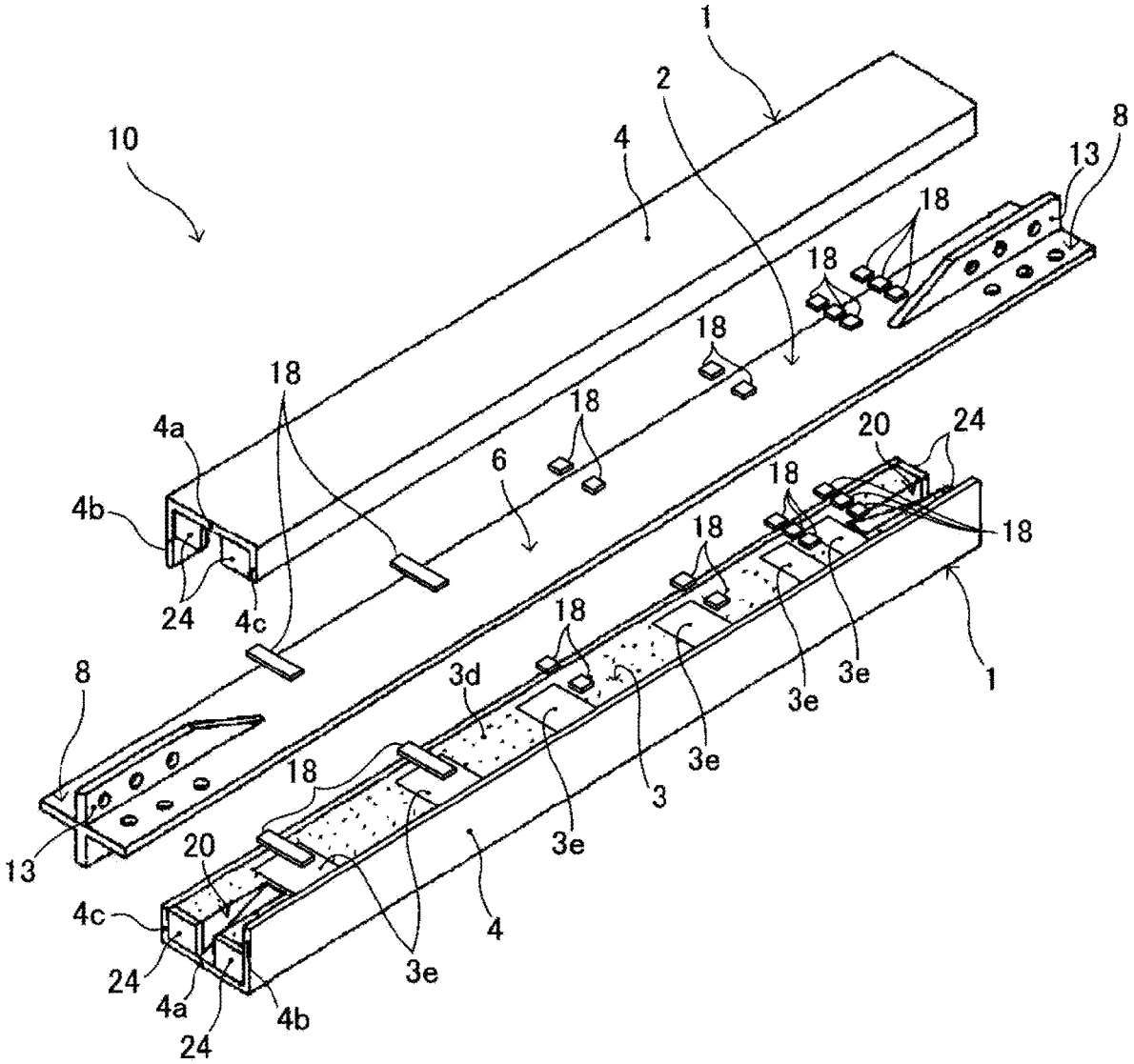
FIG. 2 is an exploded perspective view of the buckling-restrained brace.

FIG. 2 is an exploded perspective view of the buckling-restrained brace according to the embodiment 1.

Figure 3:
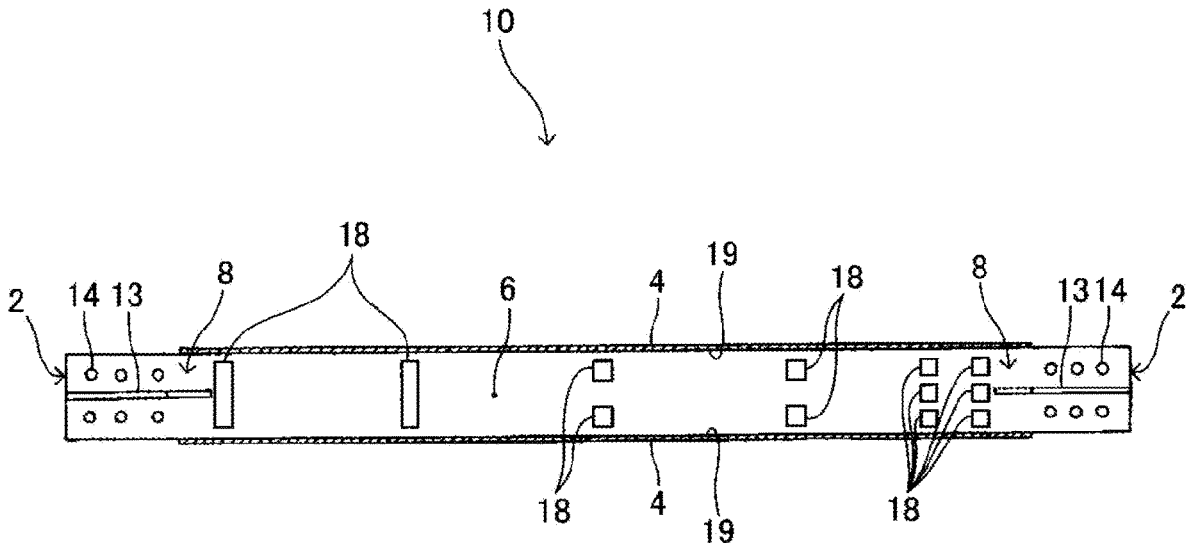
FIG. 3 is a longitudinal-sectional view showing an internal structure of the buckling-restrained brace.

FIG. 3 is a longitudinal-sectional view showing an internal structure of the buckling-restrained brace according to the embodiment 1.

Figure 4:
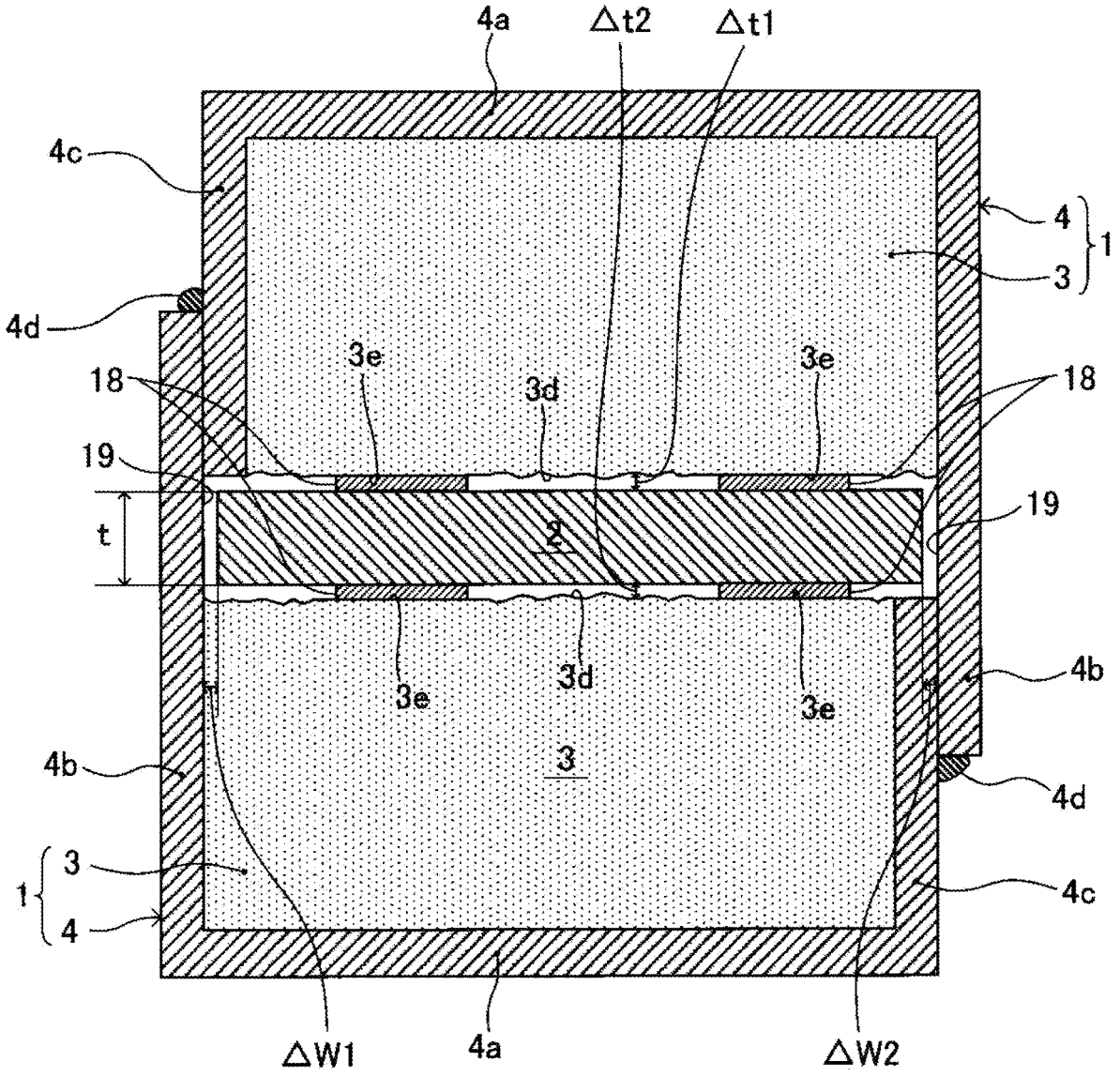
FIG. 4 is a cross-sectional view showing the internal structure of the buckling-restrained brace.

FIG. 4 is a cross-sectional view showing the internal structure of the buckling-restrained brace according to the embodiment 1.

The buckling-restrained brace 10 of the embodiment 1 is comprised of a core material 2 made of a steel plate and two buckling-restrained members 1, 1 sandwiching the core material 2. The two buckling-restrained members 1, 1 have the same structure. In the buckling-restrained members 1, 1 of the embodiment 1, concrete or mortar (in the following explanation, an example using mortar will be described) 3, 3 as curable materials are filled in frame plates 4, 4.

The core material 2 of the embodiment 1 has a flat plate shape, more specifically, a shape in which, in a cross-section perpendicular to a longitudinal direction of the core material 2 (cross-section shown in FIG. 4), a length in a direction in which the two buckling-restrained members 1, 1 face each other (up-down direction in FIG. 4) is shorter than a length in a direction perpendicular to the direction in which the two buckling-restrained members 1, 1 face each other (left-right direction in FIG. 4). In addition, the cross-sectional shape of the core material 2 is not limited to this, and may be, for example, circular, elliptical, or cross-shaped.

The core material 2 of the embodiment 1 has a single-plate structure of a steel plate including a flat core material intermediate portion 6 and connecting portions 8, 8 provided at both ends thereof. Note that the connecting portions 8, 8 may be formed by joining reinforcing plates for reinforcement to an upper and lower surface of the steel plate (a base material of the core material 2) extending from the core material intermediate portion 6. This reinforcing plates increase a strength of the connecting portions 8, 8 more than a strength of the core material intermediate portion 6.

Further, ribs 13, 13 are joined to the connecting portions 8, 8 of the core material 2, so that the cross-sectional shape is cross-shaped. Also, the connecting portions 8, 8 are formed with bolt holes 14 for installation, which are used when the buckling-restrained brace 10 is installed in a building.

The mortar materials 3, 3 comprising the buckling-restrained members 1, 1 of the embodiment 1 are mortars manufactured by filling the frame plates 4, 4 or mortar blocks manufactured at a place different from the frame plates 4, 4. Both end portions of the mortar materials 3,3 are provided with diagonal grooves 20,20 into which the ribs 13,13 provided on the connecting portions 8, 8 of the core material 2 are inserted, as shown in FIG. 2.

The frame plates 4, 4 comprising the buckling-restrained members 1, 1 of the embodiment 1 are formed of steel plates, and as shown in FIG. 4, consist of a bottom surface 4*a* and standing surfaces 4*b*, 4*c* rising from both ends thereof in the width direction (left-right direction in FIG. 4), and is configured such that the cross-sectional shape is a U-shape. In the height of the standing surfaces 4*b*, 4*c* from the bottom surface 4*a*, as shown in FIG. 4, the standing surface 4*b* is higher than the standing surface 4*c*.

Also, at both ends of the frame plates 4, 4 in the longitudinal direction, as shown in FIG. 2, a pair of patch metals 24, 24 are provided to leave a space in which the ribs 13, 13 provided on the connecting portions 8, 8 are inserted. Into the inside of each frame plates 4, 4, a pre-cured mortar material is filled, or mortar materials 3, 3 made of mortar blocks is inserted, from an opening side thereof.

Next, a method of securing a predetermined amount of clearance $\Delta t = \Delta t1 + \Delta t2$ between the core material 2 and the core-material-facing surfaces 3*d* of the two buckling-restrained members 1, 1 (the core-material-facing surfaces 3*d* of the mortar materials 3, 3) will be described.

The clearance $\Delta t$ between the core material 2 and the core-material-facing surfaces 3*d* of the two buckling-restrained members 1, 1 requires to set with high accuracy especially when the buckling-restrained brace 10 is to function as an earthquake-resistant member/seismic-response member. That is, if this clearance $\Delta t$ is too wide, the core material intermediate portion 6 of the core material 2 is plastically deformed locally in the direction in which the two buckling-restrained members 1, 1 face each other (up-down direction in FIG. 4) during an axial compressive loading of the core material 2. Conversely, if this clearance $\Delta t$ is too narrow, the core material 2 cannot deform (distort) sufficiently in the direction (up-down in FIG. 4) due to being restrained by the two buckling-restrained members 1, 1 during the axial compressive loading of the core material 2. In this case, the compressive axial force of the core material 2 flows to the buckling-restrained members 1, 1.

As a method for securing this clearance $\Delta t$, in the present embodiment 1, as shown in FIGS. 2 to 4, clearance-maintaining members 18 is provided.

Since the conventional clearance-maintaining members are sandwiched between the core-material-facing surfaces 3*d*, 3*d* of the two buckling-restrained members 1, 1 on the side of the core material 2 in the longitudinal direction, a thickness of the clearance-maintaining members requires a thickness equal to the sum of a thickness t of the core material 2 and an amount of the clearance Δt. As a result, the clearance-maintaining members become large and heavy, and a work load in handling the clearance-maintaining members increases.

On the other hand, the clearance-maintaining members 18 of the embodiment 1 are sandwiched between the core material 2 and the core-material-facing surfaces 3*d*, 3*d* of the two buckling-restrained members 1, 1, as shown in FIG. 4. Therefore, since the thickness of the clearance-maintaining members 18 may be only the amount of the clearance Δt, the clearance-maintaining members 18 can be small and light, and the work load in handling the clearance-maintaining members 18 can be reduced.

In particular, as shown in FIGS. 2 and 3, the clearance-maintaining members 18 of the embodiment 1 are dispersedly arranged at a plurality of locations separated from each other on the core-material-facing surfaces 3*d*, 3*d* of the buckling-restrained members 1, 1. Therefore, each clearance-maintaining member 18 is very small and light, and the handling work of the clearance-maintaining members 18 is very easy.

The number of clearance-maintaining members 18 or an arrangement method such as arrangement locations thereof are not particularly restricted, as long as they can maintain a predetermined amount of the clearance Δt between the core material 2 and the core-material-facing surfaces 3*d*, 3*d* of the two buckling-restrained members 1, 1 almost uniformly over the entire surface of the core material 2. Therefore, for example, as shown in FIG. 3, a predetermined number of clearance-maintaining members 18 may be dispersedly arranged at a plurality of locations in the longitudinal direction (left-right direction in FIG. 3). Note that the number of clearance-maintaining members 18 to be arranged is determined according to the sizes of each clearance-maintaining member 18, the sizes of the core material 2 and the core-material-facing surfaces 3*d*, 3*d* of the buckling-restrained members 1, 1, and the like.

Also, in the width direction (up-down direction in FIG. 3), one clearance-maintaining member 18 may be arranged as shown on the left side of the drawing. Further, two clearance-maintaining members 18 may be arranged as shown near the center of the left and right sides in the drawing. Alternatively, three clearance-maintaining members 18 may be arranged as shown on the right side of the drawing. Moreover, although not shown, four or more clearance-maintaining members 18 may be arranged.

In addition, in the embodiment 1, as shown in FIG. 3, in the width direction, they are arranged so as to be line symmetrical with respect to a line passing through the center of the width direction, while in the longitudinal direction, they are arranged so as to be asymmetrical, but this is not limited. For example, they may be arranged to be symmetrical or asymmetrical in both the width direction and the longitudinal direction.

Figure 5:
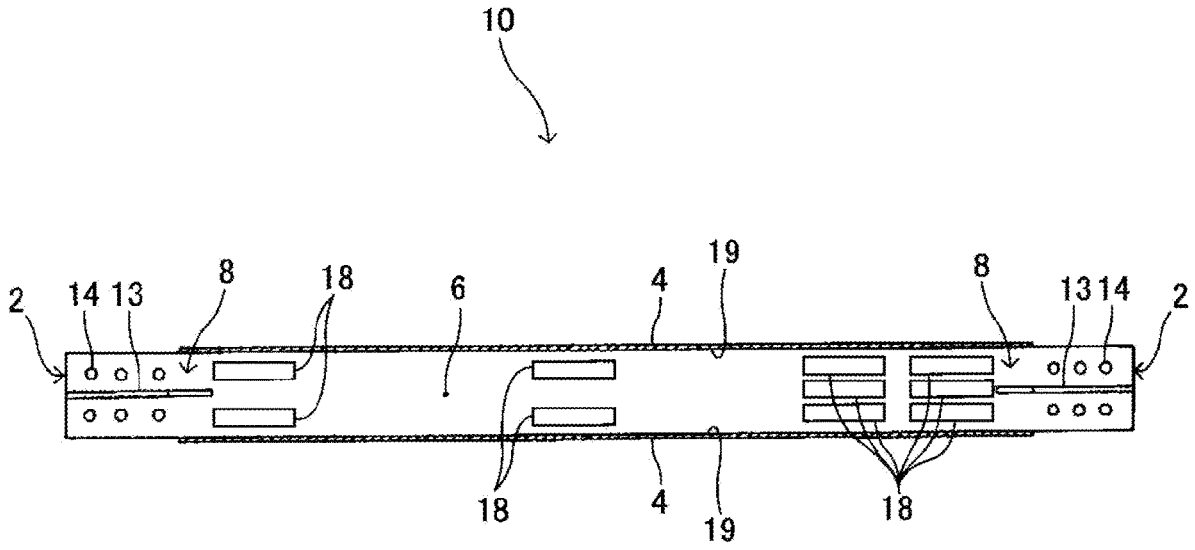
FIG. 5 is a longitudinal sectional view showing another internal structure of the buckling-restrained brace.

Also, as shown in FIG. 3, the clearance-maintaining members 18 to be arranged may have different sizes and shapes, but as shown in FIG. 5, all the clearance-maintaining members 18 may have the same sizes and shapes. In this case, only one type of clearance-maintaining member 18 is required, which is advantageous in reducing the manufacturing cost.

Further, since the clearance-maintaining members 18 of the embodiment 1 are sandwiched between the core material 2 and the core-material-facing surfaces 3*d*, 3*d* of the two buckling-restrained members 1, 1, it is necessary to have characteristics that do not hinder the deformation of the core material 2 during the axial compressive loading of the core material 2. In other words, it is necessary to have characteristics that do not hinder a function of the clearance Δt provided between the core-material-facing surfaces 3*d*, 3*d* of the two buckling-restrained members 1, 1 and the core material 2 (function of ensuring proper deformation of the core material 2 during the axial compressive loading of the core material 2). For this purpose, it is necessary to use at least members having lower rigidity or strength than the core material 2 as the clearance-maintaining members 18.

On the other hand, in a manufacturing process, the clearance-maintaining members 18 of the embodiment 1 also require sufficient rigidity or strength for maintaining a predetermined amount of the clearance Δt between the core-material-facing surfaces 3*d*, 3*d* of the two buckling-restrained members 1, 1 and the core material 2 in a state where the core material 2 and the clearance-maintaining members 18 are sandwiched between the two buckling-restrained members 1, 1 until the frame plates of two buckling-restrained members 1, 1 are fixed to each other. For example, a work of sandwiching the core material 2 and the clearance-maintaining members 18 between the two buckling-restrained members 1, 1 is usually performed by overlapping the two buckling-restrained members 1, 1 in an up-down direction, as shown in FIG. 2, in order to facilitate a manufacturing operation. Therefore, the clearance-maintaining members 18 of the embodiment 1 require rigidity or strength at least such that a predetermined amount of the clearance Δt can be maintained even when a load of one of the buckling-restrained members 1 is applied (even when a load of the core material 2 is also applied).

Suitable materials for obtaining the characteristics required for the clearance-maintaining members 18 as described above include, for example, rubber such as butyl rubber, fluororesin such as PTFE (polytetrafluoroethylene), and wood such as balsa wood. Note that the material of the clearance-maintaining members 18 is not limited to these, and an appropriately selected material can be used.

In the embodiment 1, the lower limit value of the clearance Δt (clearance when the core material 2 is shifted to one of the core-material-facing surfaces 3*d*) can be expressed as $\Delta t \geq t \times a/100 \times 0.5$ using the plastic strain a with respect to a thickness t at the core material intermediate portion 6 of the core material 2, if the Poisson's ratio of the steel material in its plastic state is 0.5. As an example, when the thickness t of the core material intermediate portion 6 of the core material 2 is 40 mm and the plastic strain a of the core material 2 is about 3% at maximum, the lower limit value of the clearance Δt is about 0.6 mm. As described above, an upper limit value of the clearance Δt is appropriately set within a range in which local plastic deformation of the core material intermediate portion 6 of the core material 2 can be prevented during the axial compressive loading of the core material 2, but because it cannot be set to a very large value, a range in which the clearance Δt can be set is narrow and high accuracy management of the clearance Δt is required.

Also, in the embodiment 1, a clearance ΔW between the side surfaces of the core material intermediate portion 6 of the core material 2 and inner walls 19 of the buckling-restrained member 1 (clearance when the core material 2 is shifted to one inner wall 19 of the buckling-restrained member 1) requires relatively high accuracy that is not as large as the clearance Δt, as well as the clearance Δt between the core material intermediate portion 6 of the core material 2 and the core-material-facing surfaces 3*d* of the two buckling-restrained members 1, 1. For example, in the above example, if the width of the core material intermediate portion 6 of the core material 2 is 400 mm, and the plastic strain a of the core material 2 is about 3% at maximum, a lower limit value of the clearance ΔW=ΔW1+ΔW2 is about 6 mm. As described above, an upper limit value of the clearance ΔW is appropriately set within a range in which local plastic deformation of the core material intermediate portion 6 of the core material 2 can be prevented during the axial compressive loading of the core material 2, but because it cannot be set to a very large value, a range in which the clearance ΔW can be set is narrow and correspondingly high accuracy management of the clearance ΔW is required.

Next, a method of manufacturing the buckling-restrained brace 10 according to the embodiment 1, which enables highly accurate control of the clearance Δt, which is a characteristic part of the present invention, will be described.

Figure 6:
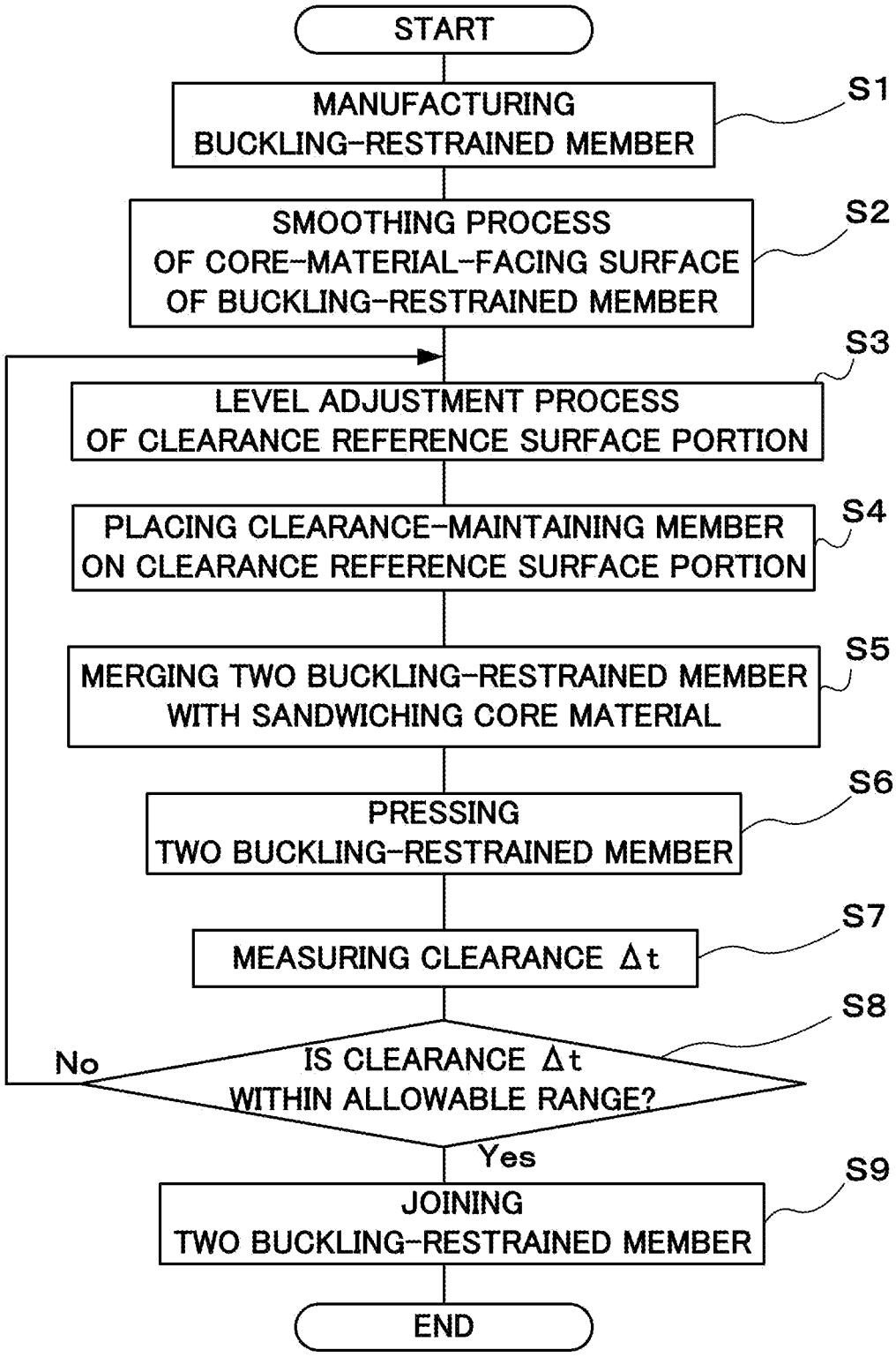
FIG. 6 is a flow chart showing a flow of a manufacturing method according to the embodiment 1.

FIG. 6 is a flow chart showing a flow of the manufacturing method according to the embodiment 1.

First, the buckling-restrained member 1 is manufactured (S1). Specifically, first, in order to manufacture the frame plate 4, a flat steel plate is bent to form the bottom surface 4*a* and the standing surfaces 4*b*, 4*c*, and then a pair of patch metals 24, 24 made of another steel plates are attached by welding. After that, into the inside of the frame plate 4, a pre-cured mortar material is filled, or a mortar material 3 made of a separately prepared mortar block is stored. The mortar material 3 is finished by plastering on the surface that is the core-material-facing surface 3*d* of the buckling-restrained member 1.

At this time, a level of the core-material-facing surface 3*d* of the buckling-restrained member 1 (here, the level is a height of the core-material-facing surface 3*d* with reference to an outer wall surface of the bottom surface 4*a* of the frame plate 4) is, on average, roughly adjusted within a predetermined level accuracy range, but locally there can be protrusions that exceed the level accuracy range. Further, the core-material-facing surface 3*d* of the buckling-restrained member 1 is a rough surface where unevenness still remains, and variations in level due to the unevenness remain.

Therefore, in the embodiment 1, if necessary, a smoothing process is performed to smooth the entire core-material-facing surface 3*d* of the buckling-restrained member 1 manufactured (S2). This smoothing process is not particularly limited as long as it removes a surface roughness and improves a flatness of the entire core-material-facing surface 3*d* which is a mortar surface in a cured state, and can remove protrusions that locally exceed the level accuracy range and also reduce unevenness. The smoothing process can be performed, for example, by using an electric tool capable of shaving the protrusions or the convex portions of unevenness on the mortar surface for the entire core-material-facing surface 3*d*. By this smoothing process, the overall level of the core-material-facing surface 3*d* is kept within the level accuracy range, and level variation due to unevenness is suppressed. In the smoothing process, for example, it is preferable to perform the smoothing process on the entire core-material-facing surface 3*d* while measuring a level at a plurality of reference points dispersedly set on the core-material-facing surface 3*d*.

Next, in the embodiment 1, a surface treatment for adjusting the amount of the clearance Δt is applied to clearance reference surface portions 3*e*, which are a portion of the core-material-facing surface 3*d* and is the portion with which the clearance-maintaining members 18 contact (hereinafter referred to as "level adjustment process") is performed (S3). This level adjustment process is a process for adjusting the level of the clearance reference surface portions 3*e* with high accuracy so that the level of the clearance reference surface portions 3*e* falls within an adjustment range (for example, 0.1 mm) narrower than the level accuracy range described above.

The reason for performing such high-accuracy adjustment of the level of the clearance reference surface portions 3*e* is as follows.

As described above, the buckling-restrained brace 10 of the embodiment 1 requires that the clearance Δt between the core material 2 and the core-material-facing surfaces 3*d* of the two buckling-restrained members 1, 1 is controlled with high accuracy. This clearance Δt is defined mainly by a thickness of the clearance-maintaining members 18 sandwiched between the core material 2 and the core-material-facing surfaces 3*d* of the two buckling-restrained members 1, 1. Therefore, in order to control the clearance Δt with high accuracy, it is first of all important that all of the clearance-maintaining members 18 are appropriately sandwiched without gaps between the core material 2 and the core-material-facing surfaces 3*d* of the two buckling-restrained members 1, 1 in a state where the two buckling-restrained members 1, 1 are merged. Therefore, when merging the two buckling-restrained members 1, 1, it is preferable to apply overall pressure to the two buckling-restrained members 1, 1 in a direction closer to each other, for example, using a tool such as a vice or a clamp. Then, after eliminating the gaps between all the clearance-maintaining members 18 and a group of the core material 2 and the core-material-facing surface 3*d*, the two buckling-restrained members 1, 1 are joined and fixed, thereby a highly accurate clearance Δt can be obtained.

However, at this time, if the level accuracy of the clearance reference surface portions 3*e* on the core-material-facing surface 3*d* with which the clearance-maintaining members 18 contact is insufficient, the following problems occur.

In order to eliminate the gaps between all the clearance-maintaining members 18 and a group of the core material 2 and the core-material-facing surface 3*d*, during the pressurizing work for wholly pressing the two buckling-restrained members 1, 1 in a direction closer to each other, a large pressure capable of displacing the buckling-restrained members 1,1 is applied. This displacement of the buckling-restrained members 1, 1 eliminates the gaps, and the clearance-maintaining members 18 are sandwiched. Subsequently, as further pressure is applied and the displacement of the buckling-restrained members 1, 1 progresses, the clearance-maintaining members 18 are crushed. At the timing when the clearance-maintaining members 18 begin to deform, a load against the pressurization increases, so if this load variation can be grasped and the displacement of the buckling-restrained members 1, 1 can be stopped at that timing, all of the clearance-maintaining members 18 can be properly sandwiched between the core material 2 and the core material facing surfaces 3*d* of the two buckling-restrained members 1, 1 without the gaps, and it is possible to obtain a predetermined amount of clearance Δt with high accuracy.

However, as described above, the clearance-maintaining members 18 need to be made of a less rigid or strong member than the core material 2, and its rigidity or strength is not very high. Therefore, in the pressurization work, the difference between a load during eliminating the gaps and a load during crushing the clearance-maintaining members 18 after eliminating the gaps is small, so it is very difficult to grasp a timing at which the clearance-maintaining members 18 begin to be crushed. Therefore, in the pressurization work, the clearance Δt may become too narrow because the buckling-restrained members 1, 1 are displaced to the extent that the clearance-maintaining members 18 are crushed greatly, or the clearance Δt may become too wide because the displacement of the buckling-restrained members 1, 1 is insufficient to eliminate the gaps, so that the predetermined amount of the clearance Δt cannot be obtained with high accuracy.

Here, conventionally, the level accuracy of the clearance reference surface portions 3*e* on the core-material-facing surface 3*d*, as well as a portion on the core-material-facing surface 3*d* other than the clearance reference surface portions 3*e*, is set within an accuracy range such that the clearance Δt is within a target accuracy range of the predetermined amount in a state where all of the clearance-maintaining members 18 are properly sandwiched without gaps between the core material 2 and the core-material-facing surfaces 3*d* of the two buckling-restrained members 1, 1. When a level of the clearance reference surface portions 3*e* is adjusted within such an accuracy range, a range of an amounts of possible gaps is too wide, thereby when the gaps are surely eliminated by displacing the buckling-restrained members 1, 1 until a maximum possible gap amount is eliminated, for example, if the actual gap amount is the minimum gap amount, the clearance-maintaining members 18 are greatly crushed, the clearance Δt becomes so narrow as to be out of the target accuracy range of the predetermined amount. Conversely, when the buckling-restrained members 1, 1 are displaced to such an extent that the clearance-maintaining members 18 are not crushed so that the clearance Δt is out of the target accuracy range of the predetermined amount, if the actual gap amount is the maximum gap amount, the gaps remains and the clearance Δt becomes so wide as to be out of the target accuracy range of the predetermined amount.

Therefore, in the embodiment 1, the level accuracy of the clearance reference surface portions 3*e* on the core-material-facing surface 3*d* with which the clearance-maintaining members 18 contact is increased, and the clearance Δt can be set within the target accuracy range of the predetermined amount. That is, by increasing the level accuracy of the clearance reference surface portions 3*e* on the core-material-facing surface 3*d*, it is possible to narrow a range of a possible gap amount. If the range of the possible gap amount becomes narrow, when the gaps are surely eliminated by displacing the buckling-restrained members 1, 1 until the maximum possible gap amount is eliminated, even if the actual gap amount is the minimum gap amount, the clearance-maintaining members 18 are not crushed so greatly that the clearance Δt is be out of the target accuracy range of the predetermined amount. Therefore, the clearance Δt can be set within the target accuracy range of the predetermined amount.

The level adjustment process for the clearance reference surface portions 3*e* on the core-material-facing surface 3*d* can be performed, for example, by using an electric tool (such as an electric planer) capable of adjusting a level of the mortar surface in a cured state. In the embodiment 1, this level adjustment process is performed not on the entire core-material-facing surface 3*d* but only on a portion of the clearance reference surface portions 3*e* with which the clearance-maintaining members 18 contact, so it is relatively easy to achieve high level accuracy for each of the clearance reference surface portions 3*e*, than when the level adjustment process is performed on the entire core-material-facing surface 3*d*, and level variations among all of the clearance reference surface portions 3*e* can be suppressed, so that all of the clearance reference surface portions 3*e* can be kept within a desired adjustment range.

After completing the level adjustment process for the clearance reference surface portions 3*e* on the core-material-facing surface 3*d* of the buckling-restrained member 1 (S3), next, the clearance-maintaining members 18 are placed on each clearance reference surface portion 3*e* on the core-material-facing surface 3*d* (S4). At this time, in order to reduce the error of the clearance Δt due to the manufacturing error (thickness error) of the clearance-maintaining members 18, an upper surface level of the clearance-maintaining members 18 (the height of the upper surface of the clearance-maintaining members 18 as placed on the clearance reference surface portions 3*e* on core-material-facing surface 3*d* with reference to the outer wall surface of the bottom surface 4*a* of the frame plate 4) may be measured, and the clearance-maintaining members 18 may be adjusted for a level deficiency by overlapping and placing the required number of thin clearance adjustment sheets on the upper surface.

After the clearance-maintaining members 18 are placed on each clearance reference surface portions 3*e* on the core-material-facing surface 3*d*, next, the two buckling-restrained members 1, 1 sandwich the core material 2 and are merged (S5). After that, by using a tool such as a vise or a clamp, the pressurizing work for wholly pressing the two buckling-restrained members 1, 1 in the direction closer to each other is performed (S6). As a result, the buckling-restrained members 1, 1 can be displaced so as to eliminate the gaps between the core material 2 and all the clearance-maintaining members 18 placed on each clearance reference surface portions 3*e*, and all of the clearance-maintaining members 18 are appropriately sandwiched between the core material 2 and the core-material-facing surfaces 3*d* of the two buckling-restrained members 1, 1 without the gaps, so that it is possible to obtain the predetermined amount of the clearance Δt with high accuracy.

In the embodiment 1, since the level of the clearance reference surface portions 3*e* on the core-material-facing surface 3*d* with which the clearance-maintaining members 18 contact is adjusted with high accuracy by the above-described level adjustment process (S3), the range of the amount of the possible gaps between the core material 2 and the clearance-maintaining members 18 during merging is narrow. Therefore, even if the buckling-restrained members 1, 1 are displaced until the maximum possible gap amount is eliminated in this pressurizing work, the clearance-maintaining members 18 are not crushed so greatly that the clearance Δt is be out of the target accuracy range of the predetermined amount. Therefore, in the pressurizing work of the embodiment 1, the buckling-restrained members 1, 1 are displaced until the maximum gap amount in a state where the level is adjusted with high accuracy by the level adjustment process.

After that, in the state where the two buckling-restrained members 1, 1 are merged and pressurized in this manner, an amount of the clearance Δt is measured as necessary (S7). At this time, since the clearance Δt is surrounded by the buckling-restrained members 1, 1, it is very difficult to directly measure the amount of the clearance Δt. Therefore, in the embodiment 1, the amount of clearance Δt is indirectly measured by measuring a distance between the outer wall surfaces of the bottom surfaces 4*a* of the frame plates 4 of the two buckling-restrained members 1, 1 in this state and using the measurement result as an index value for the amount of the clearance Δt. Thereafter, the standing surfaces 4*b* and 4*c* between the frame plates 4, 4 of the two buckling-restrained members 1, 1 are joined by fillet welding 4*d* as shown in FIG. 4 (S8). Thus, the buckling-restrained brace 10 is manufactured.

In the above measurement, if the measured value of the clearance Δt (the distance between the outer wall surfaces of the bottom surfaces 4*a* of the frame plates 4 of the two buckling-restrained members 1, 1) is out of the target accuracy range (an allowable range) of a target value (the predetermined amount) of the clearance Δt, the merging of the two buckling-restrained members 1, 1 is released, and a fine adjustment process may be performed by adding or removing the thin clearance adjustment sheet, or by replacing the clearance-maintaining member 18, on the upper surface of the clearance-maintaining members 18.

Modified Example

Next, a modified example of the buckling-restrained brace 10 in the embodiment 1 will be described.

Figure 7:
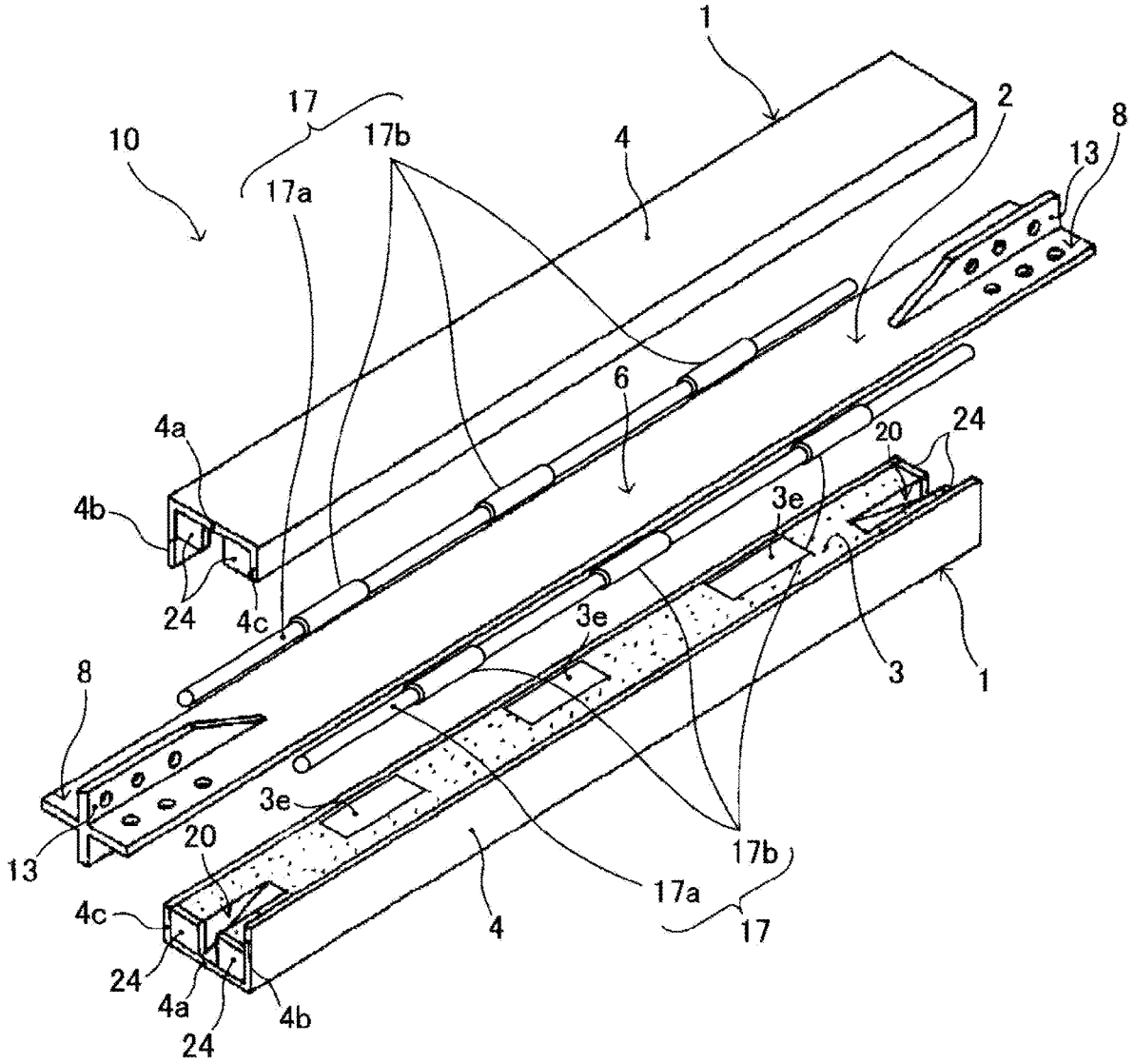
FIG. 7 is an exploded perspective view of a buckling-restrained brace according to a modified example.

FIG. 7 is an exploded perspective view of the buckling-restrained brace in the modified example.

Figure 8:
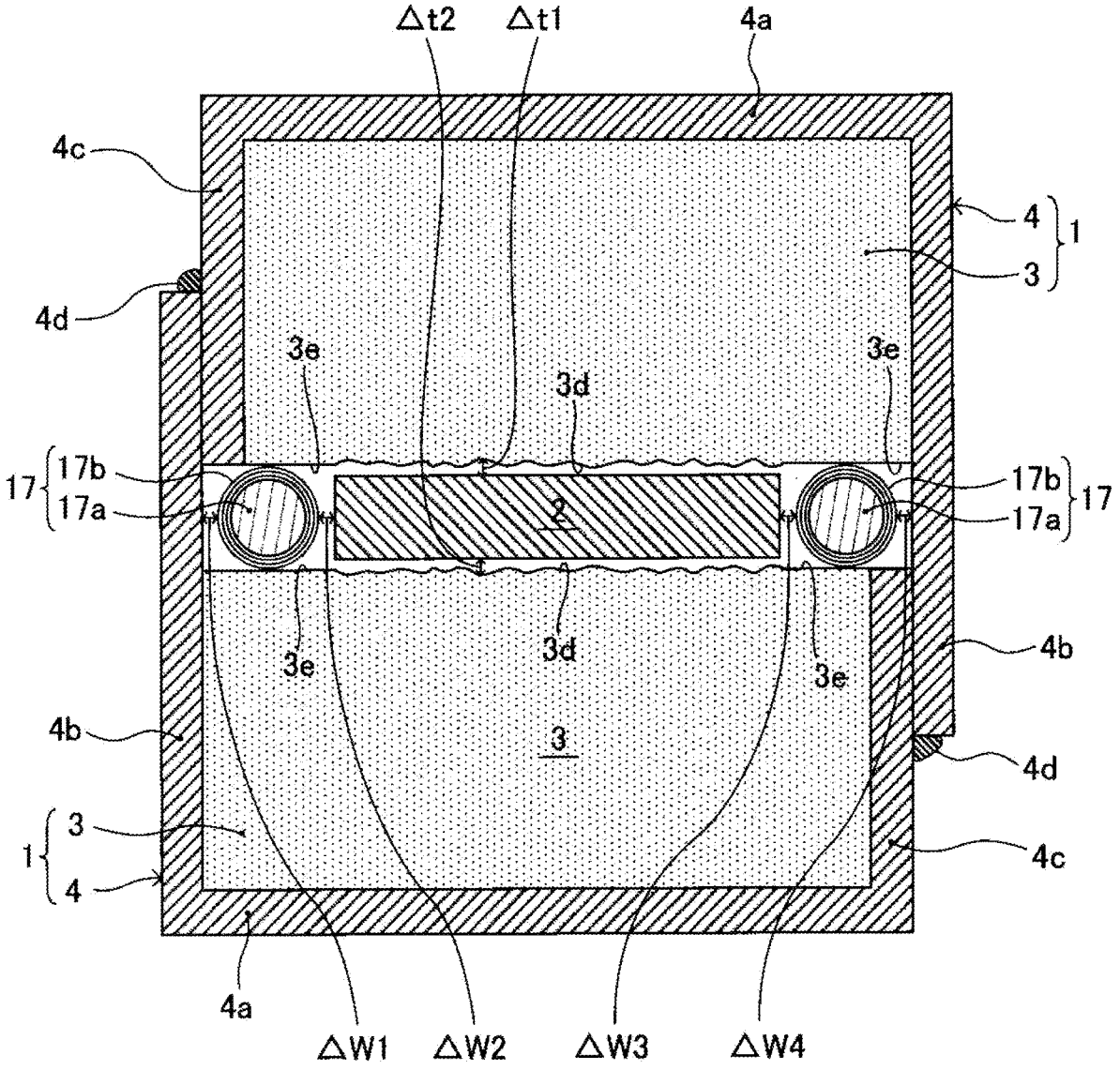
FIG. 8 is a cross-sectional view showing an internal structure of the buckling-restrained brace.

FIG. 8 is a cross-sectional view showing an internal structure of the buckling-restrained brace in the modified example.

The modified example is a type of buckling-restrained brace in which the clearance-maintaining member is sandwiched between the core-material-facing surfaces 3*d*, 3*d* of the two buckling-restrained members 1, 1 on the side of the core material in the longitudinal direction, as in the conventional art. Basic configurations of the core material 2 and the buckling-restrained members 1, 1 are the same as those of the embodiment 1 described above.

The clearance-maintaining members 17, 17 of the modified example comprise a round bar member (round steel bar) 17*a*, which is a circular cross sectional base material with a diameter capable of securing a predetermined amount of the clearance Δt between the core material 2 and the core-material-facing surfaces 3*d* of the two buckling-restrained members 1, 1 (the core-material-facing surfaces 3*d* of the mortar materials 3, 3), and a clearance adjustment material 17*b* consists of a clearance adjustment sheet wrapped around the circumference surface thereof. The clearance adjustment sheet 17*b* used in the modified example must be flexible or pliable enough to deform along this curved surface.

As an example of the clearance adjustment sheet 17*b* in the case of deforming (curving) and bonding along the circumference surface (curved surface) of the round bar member 17*a*, for example, a fluororesin sheet of about 1 mm in thickness can be suitably used as an inner clearance adjustment sheet, and a fluororesin sheet of about 0.1 mm in thickness can be suitably used as an outermost clearance adjustment sheet.

Further, in the modified example, as shown in FIG. 8, a clearance adjustment materials (clearance adjustment sheets) 17*b* are provided at a plurality of locations separated from each other in a longitudinal direction on the circumference surface of the round bar member 17*a*. With such a configuration, an amount of the clearance adjustment sheet 17*b* to be used can be reduced and lower cost can be achieved compared to the case where the clearance adjustment sheet 17*b* is provided over the entire circumference surface of the round bar member 17*a* in the longitudinal direction.

In addition, it is possible to change a thickness or the number of overlapping sheets of the clearance adjustment sheet 17*b* for each of the plurality of locations. As a result, even if a thickness of the core material 2 is uneven in the longitudinal direction, or a height of the core-material-facing surfaces 3*d* of the two buckling-restrained members 1, 1 is uneven in the longitudinal direction, it is possible to reduce an unevenness of the clearance Δt in the longitudinal direction by adjusting the thickness or the number of overlapping sheets of the clearance adjustment sheets 17*b* at each location. As a result, it is possible to obtain the clearance Δt with little unevenness in the longitudinal direction.

Note that the clearance-maintaining members 17, 17 of the modified example are examples of round bar members (round steel bars) having a circular cross section, but are not limited to this, and may be, for example, square bar members (square steel bars) having a rectangular cross section. In this case, since the surface on which the clearance adjustment sheet is provided (the outer surface of the square bar member) is flat, the clearance adjustment sheet does not need to be flexible or pliable enough to deform along the curved surface.

In addition, the clearance-maintaining members 17, 17 of the modified example also function as clearance adjustment members for adjusting a core material side clearance $\Delta W = \Delta W1 + \Delta W2 + \Delta W3 + \Delta W4$ between a side surface of the core material 2 and a core material side facing surfaces of the two buckling-restrained members 1, 1. Therefore, the clearance-maintaining members 17, 17 are configured to exist also on the sides of the connecting portions 8, 8 in the longitudinal direction.

The buckling-restrained brace 10 of the modified example is also manufactured by the same manufacturing steps (S1 to S9 in FIG. 6) as in the embodiment 1 described above. In the modified example, the clearance-maintaining members 17, 17 are not of a type sandwiched between the core material 2 and the core-material-facing surfaces 3*d*, 3*d* of the two buckling-restrained members 1, 1 (the type of the embodiment 1 described above), but of the type sandwiched between the core material facing surfaces 3*d*, 3*d* of the two buckling-restrained members 1, 1 on the sides of the core material 2 in the longitudinal direction. Therefore, although the arrangement positions of the clearance reference surface portions 3*e* on the core-material-facing surface 3*d* of the buckling-restrained member 1 is different, the manufacturing steps such as the level adjustment process of the clearance reference surface portions 3*e* are the same.

Moreover, in the modified example, the clearance adjustment materials 17*b* comprising the clearance-maintaining members 17, 17 is desired to be made of members having lower rigidity or strength than the core material 2, like the clearance-maintaining members 18 of the embodiment 1 described above. This is because there is a risk that the clearance adjustment materials 17*b* are peeled off from the round bar member 17*a* during use of the buckling-restrained brace 10, and enter between the core material 2 and the core-material-facing surfaces 3*d*, 3*d* of the two buckling-restrained members 1, 1. For this reason, it is desired that the clearance adjustment materials 17*b* have characteristics that do not hinder the deformation of the core material 2 during the axial compressive loading of the core material 2, like the clearance-maintaining member 18 of the embodiment 1.

When members having low rigidity or strength is used as the clearance adjustment materials 17*b* constituting the clearance-maintaining members 17, 17 in this way, as described in the embodiment 1, if the level accuracy of the clearance reference surface portions 3*e* on the core-material-facing surfaces 3*d* with which the clearance-maintaining members 17, 17 contact is insufficient, the predetermined amount of the clearance Δt cannot be obtained with high accuracy. Therefore, also in the modified example, by using the manufacturing steps similar to that of the above-described embodiment 1 including such as the level adjustment process of the clearance reference surface portions 3*e*, it is possible to obtain the predetermined amount of the clearance Δt with high accuracy.

Embodiment 2

Next, another embodiment (hereinafter, this embodiment will be referred to as "embodiment 2") in which the present invention is applied to a method of manufacturing a buckling-restrained brace as a buckling-restrained building material, similar to the embodiment 1 described above, will be described.

Note that the buckling-restrained brace in the embodiment 2 is of a type in which the clearance-maintaining members 18 are sandwiched between the core material 2 and the core-material-facing surfaces 3*d*, 3*d* of the two buckling-restrained members 1, 1, but a type in which the clearance-maintaining members 17 are sandwiched between the core-material-facing surfaces 3*d*, 3*d* of the two buckling-restrained members 1, 1 on the sides of the core material 2 in the longitudinal direction is equally applicable, as in the modified example described above.

In the manufacturing method according to the embodiment 1 described above, in order to adjust the level of the clearance reference surface portions 3*e* with which the clearance-maintaining members 18 contact with high accuracy, the clearance reference surface portions 3*e*, which is the mortar surface after curing, is applied to perform a surface treatment so that the level adjustment of the clearance reference surface portions 3*e* is performed. The manufacturing method of the embodiment 2 does not is use such surface treatment to perform the level adjustment of the clearance reference surface portions 3*e*, and is simpler than the manufacturing method of the embodiment 1 described above.

Figure 9:
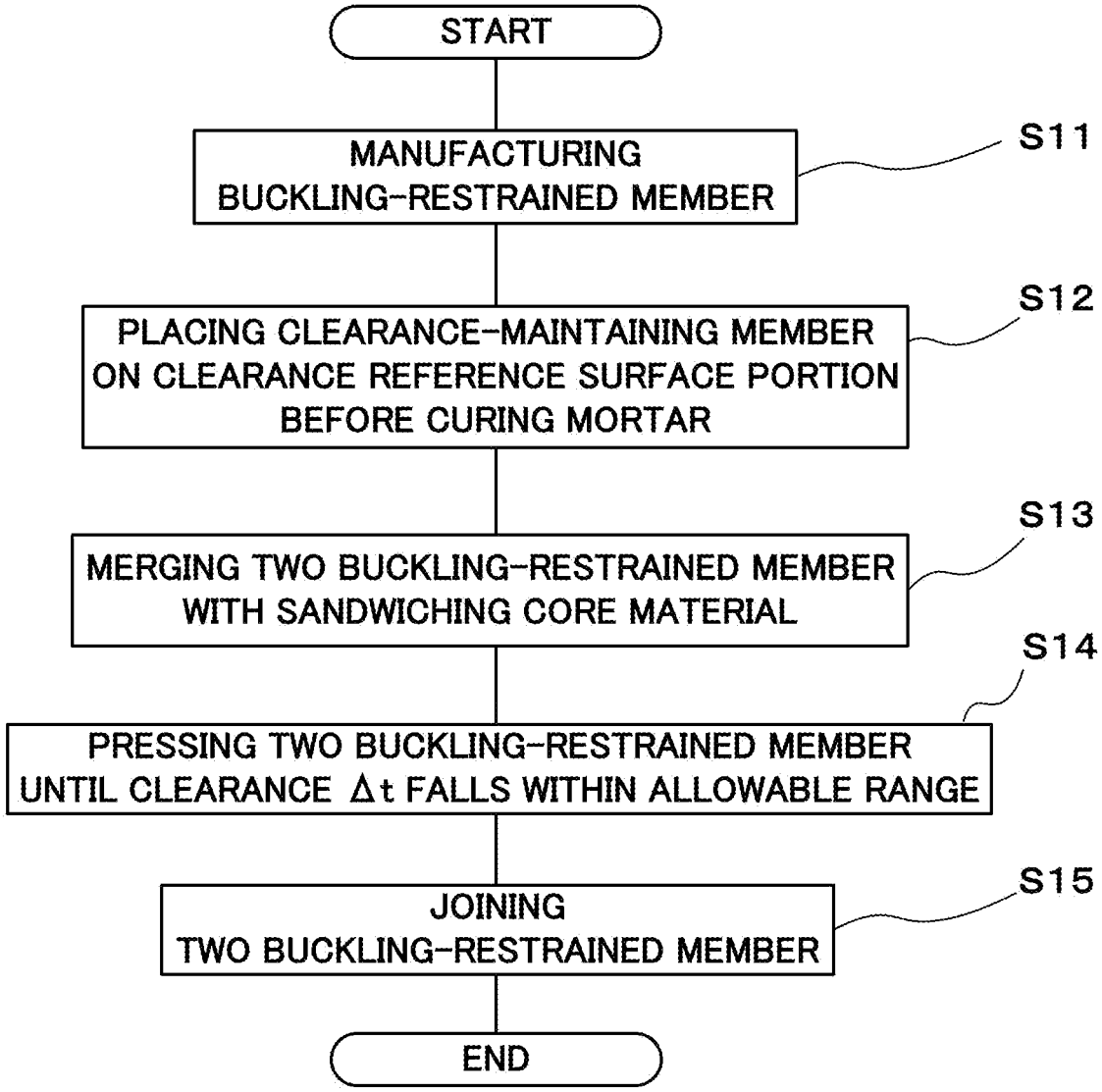
FIG. 9 is a flow chart showing a flow of a manufacturing method according to an embodiment 2.

FIG. 9 is a flow chart showing a flow of the manufacturing method according to the embodiment 2.

First, the buckling-restrained member 1 is manufactured (S11). In the embodiment 2, first, the frame plate 4 is manufactured, and the frame plate 4 is filled with a pre-cured mortar material 3'. Then, a surface of the buckling-restrained member 1, which is to be the core-material-facing surface 3*d*, is finished by plastering. At this time, a level of the core-material-facing surface 3*d* of the buckling-restrained member 1 is, on average, roughly adjusted within a predetermined level accuracy range, but locally there can be protrusions that exceed the level accuracy range. Further, the core-material-facing surface 3*d* of the buckling-restrained member 1 is a rough surface where unevenness still remains, and variations in level due to the unevenness remain.

Next, in the embodiment 2, the clearance-maintaining members 18 are placed at predetermined locations on the pre-cured mortar material 3' which forms the core-material-facing surfaces 3*d*, 3*d* of the buckling-restrained members 1, 1. Then, the clearance-maintaining members 18 are pressed into the pre-cured mortar material 3' while measuring so that an upper surface level of the clearance-maintaining members 18 (the height of the upper surface of the clearance-maintaining members 18 when the outer wall surface of the bottom surface 4*a* of the frame plate 4 is used as a reference) is a predetermined target value (value at which the clearance Δt is a predetermined amount) (S12). Then, after the mortar material 3' is cured, the two buckling-restrained members 1, 1 sandwich the core material 2 and are merged (S13). After that, in order to eliminate gaps between all the clearance-maintaining members 18 and a group of the core material 2 and the core-material-facing surface 3*d*, for example, by using a tool such as a vice or a clamp, a pressurizing work for wholly pressing the two buckling-restrained members 1, 1 in the direction closer to each other is performed (S14).

This pressurizing work is performed until the clearance Δt falls within the allowable range, and after this pressurizing work, the standing surfaces 4*b* and 4*c* between the frame plates 4, 4 of the two buckling-restrained members 1, 1 are joined by fillet welding 4*d* as shown in FIG. 4 (S15).

Note that in the method of measuring the clearance Δt, for example, similar to the embodiment 1 described above, the amount of clearance Δt is indirectly measured by measuring a distance between the outer wall surfaces of the bottom surfaces 4*a* of the frame plates 4 of the two buckling-restrained members 1, 1 and using the measurement result as an index value for the amount of the clearance Δt. In this measurement, if the measured value of the clearance Δt is out of the target accuracy range (the allowable range), the merging of the two buckling-restrained members 1, 1 is released, and a fine adjustment process may be performed by adding or removing the thin clearance adjustment sheet, or by replacing the clearance-maintaining member 18.

According to the embodiment 2, the clearance-maintaining members 18 are pushed into the mortar material 3' in a state where the mortar material 3' forming the core-material-facing surfaces 3*d*, 3*d* of the buckling-restrained members 1, 1 is not yet fully cured, or more specifically, a hardness of the mortar material 3' is lower than the clearance-maintaining members 18. This pushing makes it possible to eliminate unevenness on the surface of the mortar material 3' in contact with the clearance-maintaining members 18, and finely adjust the level of the core-material-facing surfaces 3*d*, 3*d* with which the clearance-maintaining members 18 contact. Therefore, a situation in which the clearance-maintaining members 18 is excessively crushed and the clearance Δt is out of the target accuracy range of the predetermined amount does not occur, and the clearance Δt can be set within the target accuracy range of the predetermined amount.

Embodiment 3

Next, another embodiment (hereinafter, this embodiment will be referred to as "embodiment 3") in which the present invention is applied to a method of manufacturing a buckling-restrained brace as a buckling-restrained building material, similar to the embodiment 1 and 2 described above, will be described.

The manufacturing method of the embodiment 3, like the embodiment 2 described above, is a manufacturing method that does not require a surface treatment of the cured mortar surface in order to performing the level adjustment of the clearance reference surface portions 3*e*, and is simpler than the manufacturing method of the embodiment 1 described above, but the specific manufacturing steps are different from those of the above-described embodiment 2.

Figure 10:
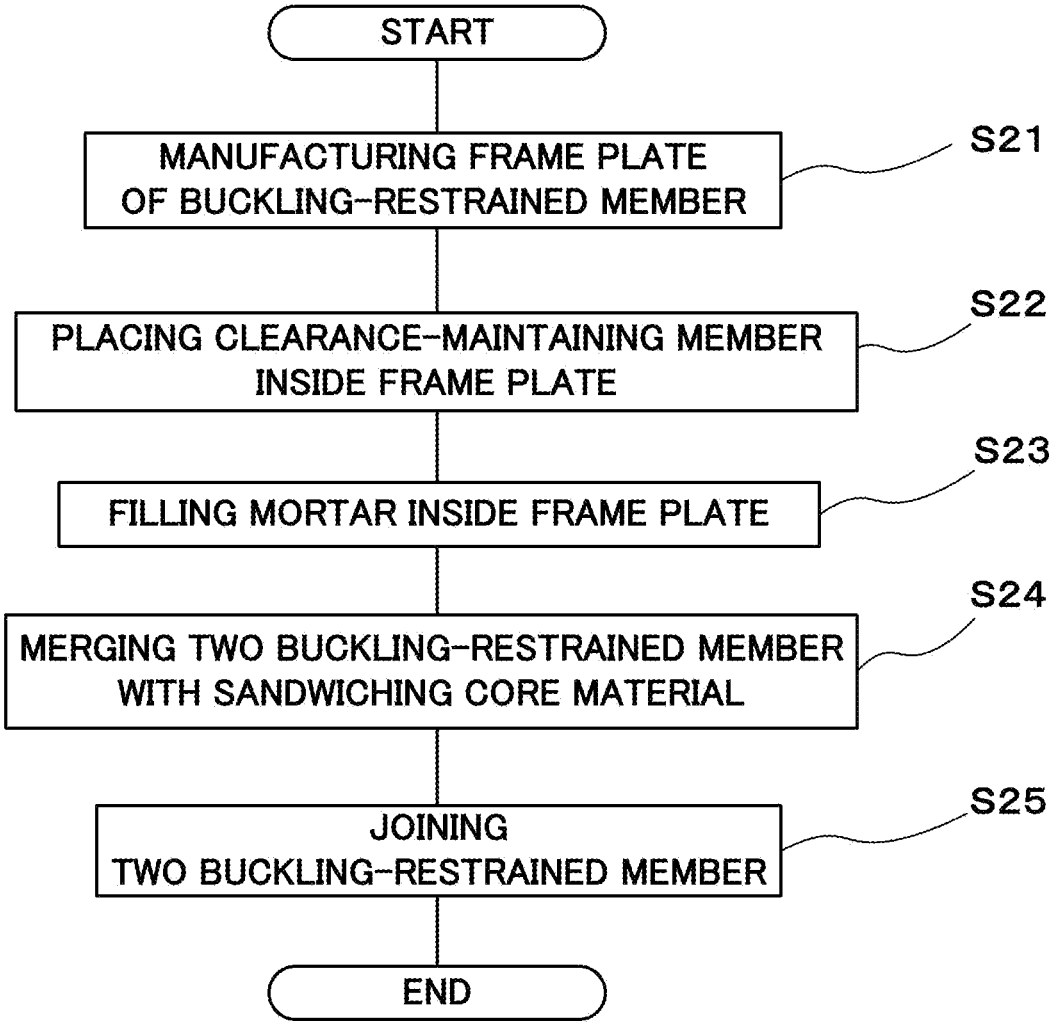
FIG. 10 is a flow chart showing a flow of a manufacturing method according to an embodiment 3.

FIG. 10 is a flow chart showing a flow of the manufacturing method according to the embodiment 3.

In the embodiment 3, first, after the frame plate 4 is manufactured (S21), one or more clearance-maintaining members 16 are placed on the bottom surface 4*a* inside the frame plate 4 (S22). The clearance-maintaining member 16 is partially arranged on the bottom surface 4*a* inside the frame plate 4 so that a space for filling a required amount of mortar in the frame plate 4 is secured. When two or more clearance-maintaining members 16 are placed, it is preferable that the clearance-maintaining members 16 are arranged dispersedly on the bottom surface 4*a* inside the frame plate 4. There are no restrictions on the shape, size, or material, etc. of the clearance-maintaining members 16, as long as its height (height from the bottom surface 4*a* inside the frame plate 4 to the upper surface of the clearance-maintaining members 16) is controlled with high accuracy.

After the clearance-maintaining members 16 are placed inside the frame plate 4 in this manner, the pre-cured mortar material 3' is poured into the frame plate 4 to fill it (S23). As in the case of the embodiment 1 described above, the surface of the mortar material 3' which becomes the core-material-facing surface 3*d* is finished by plastering. At this time, most of the clearance-maintaining members 16 is buried inside the mortar material 3', but the upper surface portions of the clearance-maintaining members 16 are exposed from the upper surface of the mortar material 3' (surface which becomes the core-material-facing surface 3*d*) for an amount equivalent to the clearance Δt. In the embodiment 3, when the mortar material 3' is finished by plastering, the upper surface of the clearance-maintaining members 16 whose heights are controlled with high accuracy can be used as a reference, so that the finishing of the upper surface of the mortar material 3' can be performed easily and with high accuracy.

After the mortar material 3' is cured, the clearance-maintaining members 16 are integrated with the mortar material 3 and fixed inside the frame plate 4, and the buckling-restrained member 1 is manufactured. Next, the two manufactured buckling-restrained members 1, 1 are used to sandwich the core material 2, and the two buckling-restrained members 1, 1 are merged (S24). As a result, the core material 2 is sandwiched in contact with the clearance-maintaining members 16, 16 of each buckling-restrained members 1, 1 at positions facing the respective core-material-facing surfaces of the two buckling-restrained members 1, 1. Then, the standing surfaces 4*b* and 4*c* between the frame plates 4, 4 of the two buckling-restrained members 1, 1 are joined by fillet welding 4*d* as shown in FIG. 4 (S25).

In the embodiment 3, since the height of the clearance-maintaining members 16 are controlled with high accuracy, a height of the core material 2 from the bottom surface 4*a* of the standing surfaces 4*b* and 4*c* can be controlled with high accuracy, and the predetermined amount of the clearance Δt can be obtained with high accuracy. If the clearance Δt is out of the target accuracy range (the allowable range), the merging of the two buckling-restrained members 1, 1 is released, and a fine adjustment process may be performed by adding or removing the thin clearance adjustment sheet, or by replacing the clearance-maintaining member 18, on the upper surface of the clearance-maintaining members 18.

Figure 11A:
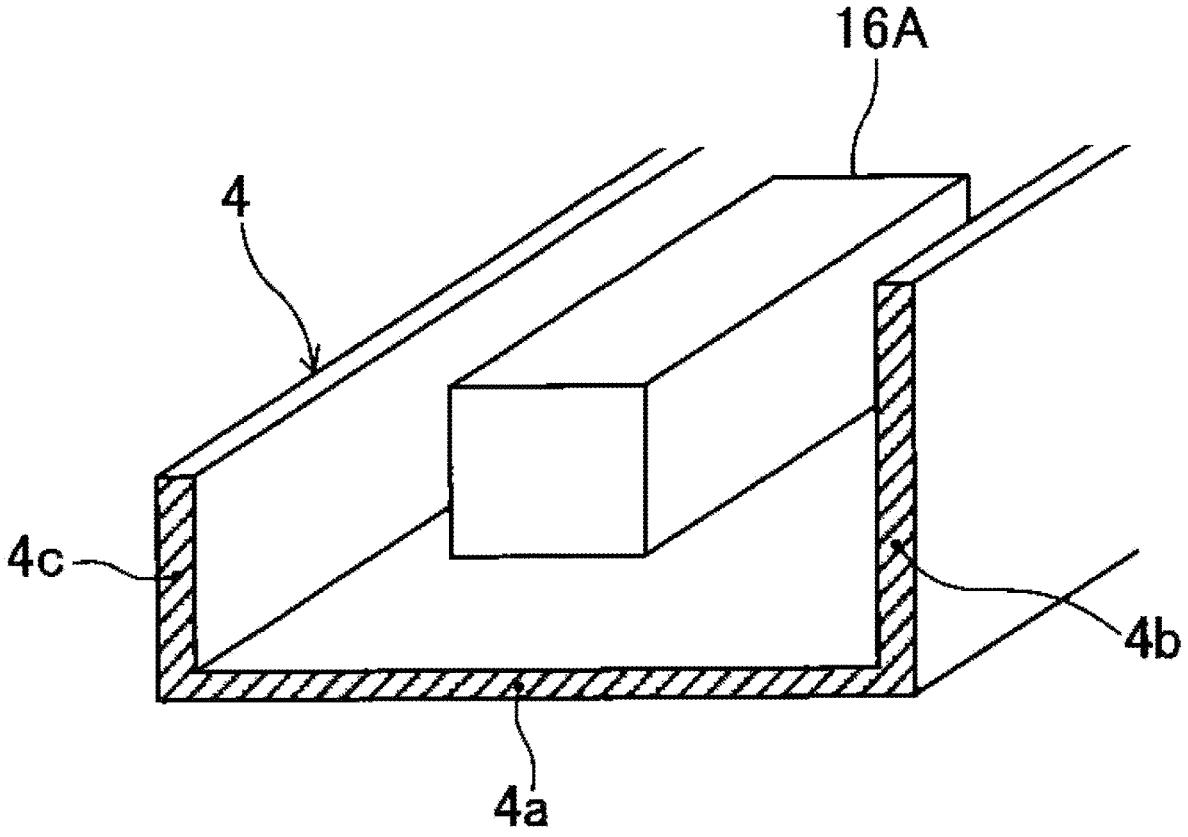
FIG. 11A is an explanatory view showing an example of clearance-maintaining members according to the embodiment 3.
Figure 11B:
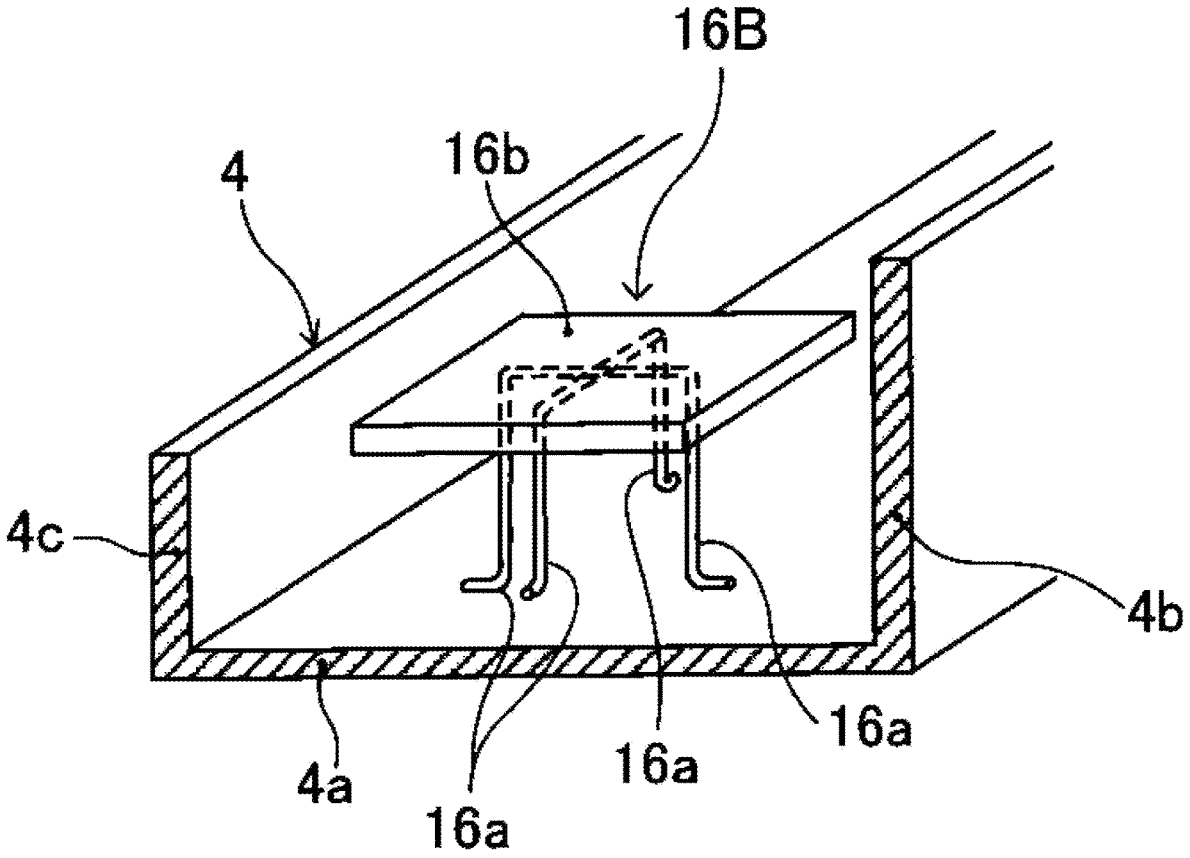
FIG. 11B is an explanatory view showing another example of the clearance-maintaining members according to the embodiment 3.
Figure 11C:
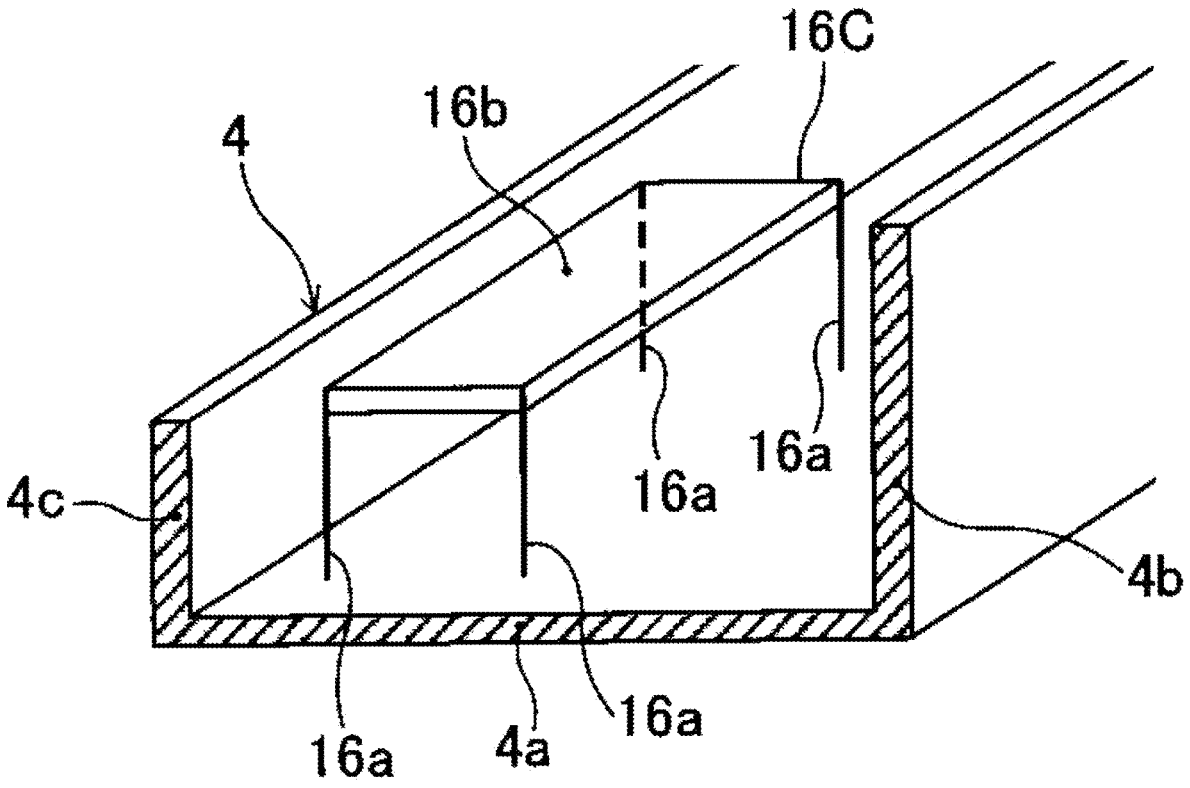
FIG. 11C is an explanatory view showing still another example of the clearance-maintaining members according to the embodiment 3.

FIG. 11A to FIG. 11C are explanatory views each showing an example of the clearance-maintaining member 16. The clearance-maintaining member 16A shown in FIG. 11A is a mortar or concrete block. Since it is relatively easy to manufacture such a block with high size accuracy, it is easy to control a height of the clearance-maintaining member 16A with high accuracy. It should be noted that a fine adjustment using a clearance adjusting material such as a clearance adjustment sheet enables more accurate control. It is preferable that a bottom surface of the block of the clearance-maintaining member 16A is adhered to the bottom surface 4*a* inside the frame plate 4 with an adhesive agent in order to prevent it from falling out or moving.

The clearance-maintaining members 16B and 16C shown in FIG. 11B and FIG. 11C are table-type members with foot portions 16*a*, for example, made by bending or welding steel wire rods, and a top plate 16*b*, made of concrete, mortar, or steel, provided on an upper surface thereof. Since the upper surfaces of these clearance-maintaining members 16B and 16C are formed by the relatively wide flat surfaces of the top plate 16*b*, the clearance-maintaining members 16B and 16C can hold stably the core material placed on the upper surfaces thereof, a work of merging the two buckling-restrained members 1, 1 becomes easier.

Also, since it is relatively easy to manufacture such clearance-maintaining members 16B and 16C with high size accuracy, it is easy to control a height of the clearance-maintaining members 16B and 16C with high accuracy. It should be noted that a fine adjustment using a clearance adjusting material such as a clearance adjustment sheet enables more accurate control. Further, the foot portions 16*a* of the clearance-maintaining members 16B and 16C can function as, for example, reinforcing bars for concrete. It is preferable that the foot portions 16*a* of the clearance-maintaining members 16B and 16C are fixed on the bottom surface 4*a* inside the frame plate 4 by welding or the like in order to prevent them from falling out or moving.

In the case of the clearance-maintaining members 16B, 16C shown in FIG. 11B and FIG. 11C, which have thin foot portions 16*a*, the pre-cured mortar material 3' is poured into and filled inside the frame plate 4 prior to placing the clearance-maintaining members 16B and 16C inside the frame plate 4, and then the foot portions 16*a* is put into the pre-cured mortar material 3' so that the foot portions 16*a* reaches the bottom surface 4*a* inside the frame plate 4, thereby the clearance-maintaining members 16B and 16C may be provided.

REFERENCE SIGNS LIST

1: buckling-restrained member
2: core material
3: mortar material
3*d*: core-material-facing surface
3*e*: clearance reference surface portion
4: frame plate
4*a*: bottom surface
4*b*, 4*c*: standing surface
6: core material intermediate portion
8: connecting portion
10: buckling-restrained brace
13: rib
16, 17, 18: clearance-maintaining member
17*a*: clearance adjustment member
17*b*: clearance adjustment material
Δt1, Δt2: clearance
ΔW1, ΔW2, ΔW3, ΔW4: core material side clearance

The invention claimed is:

1. A method of manufacturing a buckling-restrained building material in which clearance-maintaining members for securing a predetermined amount of clearance between a core material and core-material-facing surfaces of two buckling-restrained members sandwiching the core material are disposed between the core-material-facing surfaces of the two buckling-restrained members, comprising:

a clearance adjustment step for applying a surface treatment for adjusting an amount of the clearance on clearance reference surface portions which are parts of the core-material-facing surface and are in contact with the clearance-maintaining members; and a smoothing step for performing a smoothing process of the core-material-facing surface before the clearance adjustment step;

wherein, in the clearance adjustment step, the surface treatment is not applied to a surface portion other than the clearance reference surface portions on the core-material-facing surface.

2. The method of manufacturing the buckling-restrained building material according to claim 1, wherein the clearance-maintaining members have lower rigidity or strength than the core material and is sandwiched between the core-material-facing surface of at least one of the two buckling-restrained members and the core material.

3. The method of manufacturing the buckling-restrained building material according to claim 1, further comprising a pressurization step of disposing the core material and the clearance-maintaining members between the core-material-facing surfaces of the two buckling-restrained members and pressurizing the two buckling-restrained members in a direction closer to each other.

4. The method of manufacturing the buckling-restrained building material according to claim 1, further comprising a measurement step of performing a measurement for grasping an amount of the clearance, wherein the clearance adjustment step is repeated until a measurement result of the measurement step falls within a target accuracy range of the predetermined amount.

5. The method of manufacturing the buckling-restrained building material according to claim 1, wherein the clearance reference surface portions are provided at a plurality of locations separated from each other on the core-material-facing surface.

* * * * *